United States Patent [19]

Levander

[11] Patent Number: 4,838,190

[45] Date of Patent: Jun. 13, 1989

[54] PASSENGER SHIP

[75] Inventor: Kai Levander, Grankulla, Finland

[73] Assignee: Oy Wärtsilä Ab, Helsinki, Finland

[21] Appl. No.: 277,478

[22] Filed: Nov. 23, 1988

Related U.S. Application Data

[63] Continuation of Ser. No. 433,361, Oct. 7, 1982, abandoned.

[30] Foreign Application Priority Data

Oct. 13, 1981 [FI] Finland ..... 813162

[51] Int. Cl.[4] ..... B63B 1/00

[52] U.S. Cl. ..... 114/56; 114/71; 114/189

[58] Field of Search ..... 114/56, 71, 188, 189, 114/211, 270; D12/315

[56] References Cited

U.S. PATENT DOCUMENTS 646,591 4/1900 Angstrom ..... 114/211

OTHER PUBLICATIONS

Schiff Und Hafen, vol. 9/1965, pp. 730, 731.

"Prinses Beatrix", *Motor Ship,* Apr. 1979, pp. 42A, 42B.

Drawings of Ship, "Song of America".

*Primary Examiner*—Joseph F. Peters, Jr.

*Assistant Examiner*—Jesûs D. Sotelo

*Attorney, Agent, or Firm*—Dellett, Smith-Hill and Bedell

[57] ABSTRACT

A big passenger ship having passenger cabins as well as general purpose spaces and service rooms. The ship is divided into an upper part and a lower part of which the lower part extends up to the uppermost deck reaching all over the hull of the ship. The lower part is at least substantially free from passenger cabins and least substantially all of the passenger cabins are in the form of outside cabins located to a multifloor unit forming the upper part of the ship. This unit is considerably narrower than the lower part of the ship and is constructed according to the rules applicable to constructions above the uppermost through-going deck of a ship.

39 Claims, 1 Drawing Sheet

PASSENGER SHIP

Figure 1:
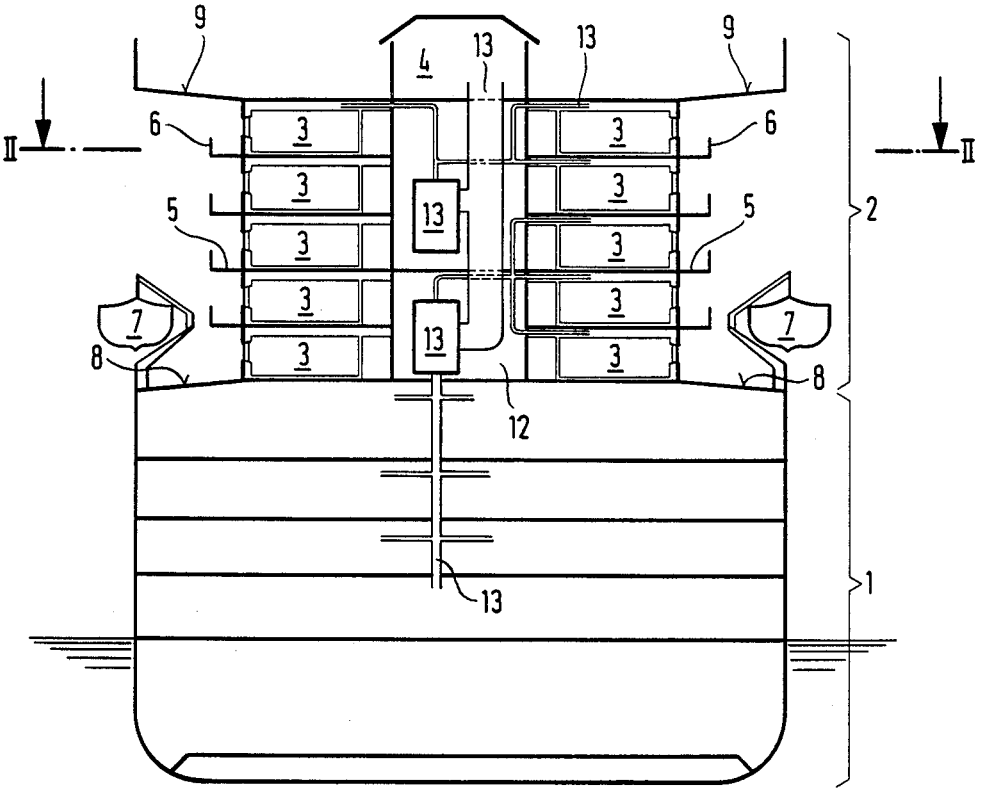

This is a continuation of application Ser. No. 06/433,361 filed Oct. 7, 1982 and now abandoned.

The invention relates to a big passenger ship comprising passenger cabins as well as general purpose spaces and service rooms. The expression "big passenger ship" means in this specification and in the claims a passenger ship with several hundreds of passenger cabins.

In a passenger ship, the passenger cabins are usually so arranged, that some cabins are so called outside cabins at the sides of the ship and other cabins are inside cabins in the interior of the ship. The inside cabins cannot have any windows, and for this reason the passengers are not willing to pay the same price for these cabins as for outside cabins. Attempts have been made to solve this problem by arranging all passenger cabins as outside cabins, but then it has been necessary to place them on so many decks, that the general plan of the ship has become complicated due to the regulations for passenger spaces below and above the highest through-going deck. In addition, many passenger cabins have been placed on so low decks that they have not been attractive to the passengers for this reason. A typical example of such a ship is presented in Schiff und Hafen No. 9/1965, pages 727–734.

An object of the invention is to solve the problem mentioned above by applying a new design principle making the all-over structure of the ship simpler and more economic. The invention is characterized in that the ship is divided into an upper part and a lower part of which the lower part extends up to the uppermost through-going deck, that is, a deck extending all over the hull of the ship, that the lower part is at least substantially free from passenger cabins, and that at least substantially all of the passenger cabins are in the form of so called outside cabins located in a multifloor unit forming the upper part of the ship, which unit is considerably narrower than the lower part of the ship and is constructed according to the rules applicable to constructions above the uppermost through-going deck. This design principle gives the advantage that all the cabins are situated in a portion of the ship, which according to the shipbuilding rules is not classified as a part of the hull but as a superstructure for which other rules are applicable than for the actual hull of the ship. This gives a number of advantages, with respect to the building requirements of the cabins and also makes its much easier to arrange for the necessary passage-ways between the different floors of the passenger cabin compartment.

The lower part of a ship according to the invention forms the actual hull of the ship and is to be built according to the regulations applicable to the hull structure. The invention makes it considerably easier to fulfil these regulations, since the general layout is not complicated by a large number of passenger cabins. The ship shown in the known art publication referred to above is a good example of the difficulties arising when part of the passenger cabins are below the uppermost through-going deck and part of the passenger cabins are above this deck. This ship would not, with respect to several of its passage-way arrangements, fulfil the rules in force today for passenger ships.

The invention gives the advantage, that all passenger cabins are outside cabins, that is, of the type most attractive to the passengers. Because the cabins are all in a portion of the ship, that can be classified as a superstructure, they can be built in a simpler way than if they were a part of the hull portion of the ship. In particular, it is convenient to make the cabins in the form of prefabricated cabin elements, which from the outside can be pushed into their proper place. Due to the location of the cabins, the outer wall structure does not have to fulfil very severe requirements as to strength, wave impact endurance etc.

Since all technical equipment such as water and sewer pipes, air conditioning ducts, electrical cables, passage-ways such as stairs and elevators, etc. can be arranged between the two rows of outside passenger cabins, the total length of all tubing, wiring etc. can be kept at a minimum. An arrangement including a through-going central vertical space for the technical equipment also makes it possible to reduce the length and number of horizontal tube and duct portions, whereby the vertical distance between the decks in the passenger cabin compartment can be reduced. The arrangement according to the invention also has a favourable influence on the stability of a ship, because the center of gravity of the ship will be at a lower level than in conventional ships. Also the life boats can be placed on a lower level. Further, the invention makes it possible to arrange balconies or a walking-way outside the cabins, and the windows of the cabins can be made large, because they are sheltered for heavy wave impacts.

The best place for the life boats of the ship is outside the passenger cabins compartment at its lowermost deck. Due to practical reasons, the support system of the life boats requires some space in the vertical direction, so that the life boats will in practice be situated between the first and second floor of the passenger cabin compartment. At this level the life boats will disturb the outlook from the passenger cabins as little as possible.

By separating all the technical equipment from the passenger cabins and locating it in a central vertical space, the noise produced by its use will not be disturbing in the passenger cabins.

It is of advantage to place, above the narrow passenger cabin compartment, a light broad structure, for instance a sun deck or the like. This improves the appearance of the ship and also forms a shelter for the passenger cabins against the sun as well as shelters the balconies of the passenger cabins against rain.

Figure 2:
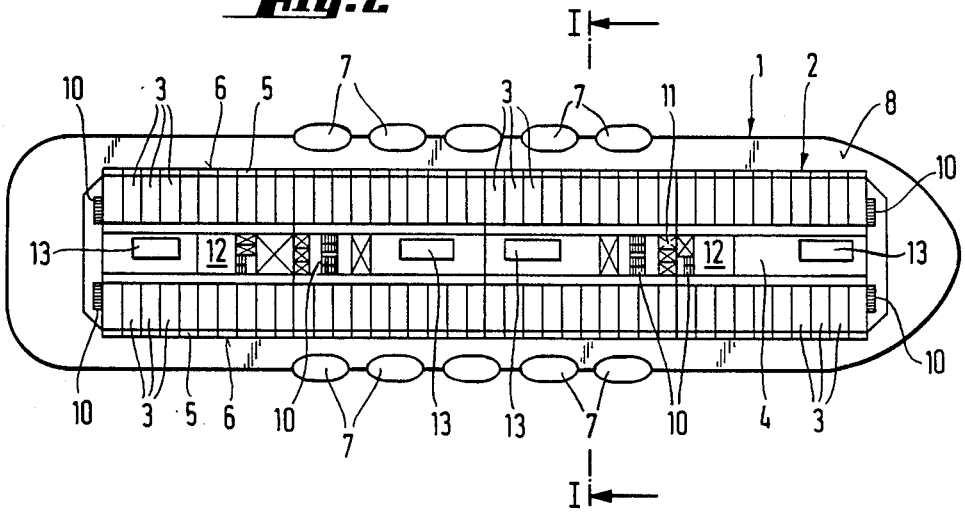

The invention will now be described, by way of example, with reference to the accompanying drawing, in which FIG. 1 shows a cross-section of a ship according to the invention, FIG. 2 shows section II—II of FIG. 1.

In the drawing, the reference numeral 1 generally designates the lower part of a ship according to the invention and the reference numeral 2 the narrower upper part of the ship, where the passenger cabins 3 are located. The broad lower part of the ship forms the hull of the ship and the narrower upper part is a superstructure. All general purpose spaces such as entrance hall, shopping area, exposition area, restaurants and show rooms, crew cabins and store rooms as well as the driving machinery, necessary auxiliary machinery, fuel and water tanks etc. are located in the lower part of the ship. The location of all these general purpose spaces in the hull portion of the ship and their complete separation from the passenger cabin compartment gives short passage-ways, effective function and a peaceful passenger cabin compartment.

In the middle of the narrow passenger cabin compartment there will usually be free space available and then it is of advantage to form a vertical through going duct 4, where passage-ways and transport means such as stairs 10, and elevators 11, as well as working and store rooms 12 for the cabin service and necessary tubes and ducts, for instance large air-conditioning ducts 13 can be located. The vertical duct 4 can extend downwards below the passenger cabin compartment, if so desired. In the longitudinal direction of the ship, the duct 4 can be as long as the passenger cabin compartment, but it may also be shorter.

All the passenger cabins 3 can be made identical which is an important advantage with respect to production technology. The hull of the ship, that is, the lower part of the ship can be built quite independently of the passenger cabins, which can be made in the form of module units, which from the sides are pushed into proper place in the framework of the passenger cabin compartment. This also means that a passenger cabin, which for instance has been destroyed by fire, can quickly be replaced by another cabin unit.

At the outside of each cabin unit 3 there may be a balcony 5 with a fence 6, so constructed that it will not be an obstacle when a cabin unit is installed or replaced. The balconies 5 can be separate for each cabin or they can be joined in the longitudinal direction of the ship to form walking-ways. The system can be different at different levels.

The life boats 7 of the ship can be arranged outside the narrow passenger cabin compartment. As shown in FIG. 1, the life boats can with advantage be arranged between the first and the second floor of the passenger cabin compartment. This will give a solution where it is suitable to arrange outside the passenger cabins of the first floor a walking-way 8 extending in the longitudinal direction of the ship, and in the higher floors, balconies 5.

At the top of the narrow passenger cabin compartment, some light broad unit can be arranged, for instance, a sun deck construction 9. To this unit also the rooms of the officers, swimming pools, a so called sky bar etc. can be located.

The invention is not limited to the shown embodiments, but several modifications thereof are feasible within the scope of the attached claims.

I claim:

1. A big passenger ship comprising a hull, a number of through-going decks integral with said hull and defining general purpose spaces and service rooms therebetween, and a multifloor unit disposed above the uppermost through-going deck and extending over the major part of the length of the uppermost through-going deck, said multifloor unit defining two ranks of passenger cabins disposed at the outside of the multifloor unit and at opposite sides respectively of the multifloor unit and having between them, in a central portion of the ship, a wide vertical space that extends over the major part of the length of the multifloor unit and passes through at least two floors of said multifloor unit, the ship also comprising an air conditioning system and said wide vertical space containing bulky components of said air conditioning system.

2. A ship according to claim 1, wherein the wide vertical space contains air conditioning ducts.

3. A ship according to claim 1, wherein the space beneath the uppermost through-going deck is substantially free of passenger cabins.

4. A ship according to claim 1, wherein the multifloor unit is considerably narrower than the uppermost through-going deck over the major part of the length of the multifloor unit.

5. A ship according to claim 1, wherein the multifloor unit forms an abrupt considerable narrowing of the ship's lateral dimension above the uppermost through-going deck over a major part of the length of the multifloor unit.

6. A ship according to claim 5, in which the narrowing of the ship's lateral dimension is sufficient to accommodate life boats.

7. A ship according to claim 1, in which there is a balcony or the like at the outside of a plurality of the passenger cabins of the multifloor unit.

8. A ship according to claim 7, wherein there is a balcony or the like at the outside of a majority of the passenger cabins of the multifloor unit.

9. A ship according to claim 1, in which there is, at the top of said multifloor unit, a broader light construction, such as a sun deck or the like.

10. A ship according to claim 1, in which said wide vertical space contains general purpose arrangements serving the internal transport needs of the ship.

11. A ship according to claim 10, in which said wide vertical space contains stairs and elevators.

12. A ship according to claim 1, in which there is, at the outside of the passenger cabins, a walking-way that extends in a longitudinal direction of said ship.

13. A ship according to claim 1, in which the multifloor unit contains, at least on each of said two floors thereof, two passageways at opposite respective sides of said wide vertical space, the passageways providing access to the passenger cabins on said two floors of the multifloor unit.

14. A big passenger ship comprising a hull, a number of through-going decks integral with said hull and defining general purpose spaces and service rooms therebetween, and a multifloor unit disposed over the uppermost through-going deck, said multifloor unit defining two ranks of passenger cabins disposed at the outside of the multifloor unit and at opposite sides respectively of the multifloor unit and having between them, in a central portion of the ship, a wide vertical space that extends over the major part of the length of the multifloor unit and passes through at least two floors of said multifloor unit, and the ship also comprising an air conditioning system and said wide vertical space containing bulky components of said air conditioning system, and substantially all passenger cabins above the uppermost through-going deck being in the multifloor unit.

15. A ship according to claim 14, wherein the wide vertical space contains air conditioning ducts.

16. A ship according to claim 14, wherein the space beneath the uppermost through-going deck is substantially free of passenger cabins.

17. A ship according to claim 14, wherein the multifloor unit is considerably narrower than the uppermost through-going deck over the major part of the length of the multifloor unit.

18. A ship according to claim 14, wherein the multifloor unit forms an abrupt considerable narrowing of the ship's lateral dimension above the uppermost through-going deck over a major part of the length of the multifloor unit.

19. A ship according to claim 18, in which the narrowing of the ship's lateral dimension is sufficient to accommodate life boats.

20. A ship according to claim 14, in which there is a balcony or the like at the outside of a plurality of the passenger cabins of the multifloor unit.

21. A ship according to claim 20, wherein there is a balcony or the like at the outside of a majority of the passenger cabins of the multifloor unit.

22. A ship according to claim 14, in which there is, at the top of said multifloor unit, a broader light construction, such as a sun deck or the like.

23. A ship according to claim 14, in which said wide vertical space contains general purpose arrangements serving the internal transport needs of the ship.

24. A ship according to claim 23, in which said wide vertical space contains stairs and elevators.

25. A ship according to claim 14, in which there is, at the outside of the passenger cabins, a walking-way that extends in a longitudinal direction of said ship.

26. A ship according to claim 14, in which the multifloor unit contains, at least on each of said two floors thereof, two passageways at opposite respective sides of said wide vertical space, the passageways providing access to the passenger cabins on said two floors of the multifloor unit.

27. A big passenger ship comprising a hull, a number of through-going decks integral with said hull and defining general purpose spaces and service rooms therebetween, and a superstructure disposed above the uppermost through-going deck, the superstructure comprising a multifloor unit that extends over a major part of the length of the superstructure and defines two ranks of passenger cabins disposed at the outside of the multifloor unit and at opposite sides respectively of the multifloor unit and having between them, in a central portion of the ship, a wide vertical space that extends over the major part of the length of the multifloor unit and passes through at least two floors of said multifloor unit, and the ship also comprising an air conditioning system and said wide vertical space containing bulky components of said air conditioning system.

28. A ship according to claim 27, wherein the wide vertical space contains air conditioning ducts.

29. A ship according to claim 27, wherein the space beneath the uppermost through-going deck is substantially free of passenger cabins.

30. A ship according to claim 27, wherein the multifloor unit is considerably narrower than the uppermost through-going deck over the major part of the length of the multifloor unit.

31. A ship according to claim 27, wherein the multifloor unit forms an abrupt considerable narrowing of the ship's lateral dimension above the uppermost through-going deck over a major part of the length of the multifloor unit.

32. A ship according to claim 31, in which the narrowing of the ship's lateral dimension is sufficient to accommodate life boats.

33. A ship according to claim 27, in which there is a balcony or the like at the outside of a plurality of the passenger cabins of the multifloor unit.

34. A ship according to claim 27, wherein there is a balcony or the like at the outside of a majority of the passenger cabins of the multifloor unit.

35. A ship according to claim 27, in which the superstructure further comprises, above said multifloor unit, a broader light construction, such as a sun deck or the like.

36. A ship according to claim 27, in which said wide vertical space contains general purpose arrangements serving the internal transport needs of the ship.

37. A ship according to claim 36, in which said wide vertical space contains stairs and elevators.

38. A ship according to claim 27, in which there is, at the outside of the passenger cabins, a walking-way that extends in a longitudinal direction of said ship.

39. A ship according to claim 27, in which the multifloor unit contains, at least on each of said two floors thereof, two passageways at opposite respective sides of said wide vertical space, the passageways providing access to the passenger cabins on said two floors of the multifloor unit.

* * * * *